US007066048B2

(12) United States Patent
Sauvonnet et al.

(10) Patent No.: US 7,066,048 B2
(45) Date of Patent: Jun. 27, 2006

(54) BRAKE PEDAL DESIGNED TO EQUIP A MOTOR VEHICLE

(75) Inventors: Franck Sauvonnet, Fontenay Sous Bois (FR); Brian N. Orr, Chesterfield Township, MI (US); Waldemar W. Gmurowski, Sterling Heights, MI (US)

(73) Assignees: Peugeot Citroën Automobiles SA, Neuilly sur Seine (FR); Delphi Technologies, Inc., Troy, MI (US)

( * ) Notice: Subject to any disclaimer, the term of this patent is extended or adjusted under 35 U.S.C. 154(b) by 106 days.

(21) Appl. No.: 10/297,034

(22) PCT Filed: Feb. 18, 2002

(86) PCT No.: PCT/FR02/00604

§ 371 (c)(1),
(2), (4) Date: Nov. 27, 2002

(87) PCT Pub. No.: WO02/067071

PCT Pub. Date: Aug. 29, 2002

(65) Prior Publication Data

US 2003/0164058 A1 Sep. 4, 2003

(30) Foreign Application Priority Data

Feb. 19, 2001 (FR) ..... 01 02216

(51) Int. Cl.
*G05G 1/14* (2006.01)

(52) U.S. Cl. ..... 74/512

(58) Field of Classification Search ..... 74/512, 74/560

See application file for complete search history.

(56) References Cited

U.S. PATENT DOCUMENTS

| | | | | |
|---|---|---|---|---|
| 3,059,960 | A | 10/1962 | Komorowski et al. | |
| 3,511,109 | A | 5/1970 | Tanaka | |
| 5,078,024 | A * | 1/1992 | Cicotte et al. | 74/512 |
| 5,183,308 | A | 2/1993 | Koga et al. | |
| 5,771,752 | A | 6/1998 | Cicotte | |
| 6,073,515 | A | 6/2000 | Elton et al. | |
| 6,151,985 | A | 11/2000 | Garber et al. | |
| 6,189,409 | B1 * | 2/2001 | Neag et al. | 74/512 |
| 6,314,831 | B1 | 11/2001 | Rixon et al. | |
| 6,360,629 | B1 * | 3/2002 | Schambre et al. | 74/512 |
| 6,364,047 | B1 | 4/2002 | Bortolon | |

(Continued)

FOREIGN PATENT DOCUMENTS

DE 19916812 9/1999

(Continued)

*Primary Examiner*—Chong H. Kim
(74) *Attorney, Agent, or Firm*—Gary M. Cohen

(57) ABSTRACT

A brake pedal (1) for a vehicle, in particular, a motor vehicle, includes a framework structure (2) mounted for rotation about a first rotation spindle (3) connectable to the bulkhead of the vehicle. A peg (5) is fixed to one end (4*a*) of a pedal web (4) and slides in a slot (21) provided in the framework structure (2). A movement mechanism (7) causes the peg to slide in the slot, defining a length (L) between the rotation spindle of the framework structure and the other end (4*b*) of the pedal web. A first link (8) is connected to the framework structure and is mounted for rotation about a second rotation spindle (9) connectable to the bulkhead of the vehicle. The first link includes a connection (13) for receiving an end of the rod of the brake booster of the vehicle at a distance (R) from the second rotation spindle. The brake pedal operates to provide a constant step-down ratio (L/R).

17 Claims, 2 Drawing Sheets

U.S. PATENT DOCUMENTS

| | | | |
|---|---|---|---|
| 6,367,348 | B1 | 4/2002 | Toelke et al. |
| 6,450,061 | B1 | 9/2002 | Chapman et al. |
| 6,510,761 | B1 | 1/2003 | Zhang et al. |
| 6,527,327 | B1 | 3/2003 | Gaus et al. |
| 6,584,871 | B1 | 7/2003 | Burton et al. |
| 2002/0157497 | A1 | 10/2002 | Porter et al. |
| 2003/0094070 | A1 | 5/2003 | O'Neill |

FOREIGN PATENT DOCUMENTS

| | | |
|---|---|---|
| EP | 0353958 | 2/1990 |
| EP | 0410815 | 1/1991 |
| GB | 1278919 | 6/1972 |
| JP | 10297345 | 11/1998 |
| KR | 99034614 | 5/1999 |
| WO | WO/0073099 | 12/2000 |

* cited by examiner

BRAKE PEDAL DESIGNED TO EQUIP A MOTOR VEHICLE

BACKGROUND OF THE INVENTION

The present invention relates to an adjustable brake pedal for use in a vehicle, particularly a motor vehicle.

It is known practice for adjustable pedalboxes to be fitted in motor vehicles. Some are currently used in vehicles equipped with automatic gearboxes, and are controlled from a control unit which is accessible from the driving position. The term "adjustable" means that all or part of the pedalbox can be moved longitudinally of the vehicle, closer to or away from the driver's seat, so that it is made possible to tailor the position of at least part of the pedalbox to the position of the driver's seat, and therefore, to the driver's size.

It is also known practice, in vehicles equipped with mechanical gearboxes, to provide a brake pedal which can be adjusted to suit the size of the driver. One known adjustable brake pedal includes a framework structure which is mounted for rotation about a first rotation spindle connected to the bulkhead of the vehicle. A peg is fixed to one end of a pedal web, and is configured to slide in a slot provided in the framework structure. A movement mechanism is provided to cause the peg to slide in the slot, defining a length (L) between the rotation spindle of the framework structure and the other end of the pedal web. A link is connected to the framework structure, and is mounted for rotation about a second rotation spindle which is configured for connection to the bulkhead of the vehicle, to receive the end of a rod associated with the brake booster of the vehicle at a distance (R) from the second rotation spindle.

This type of adjustable brake pedal is not entirely satisfactory, particularly for small drivers. The reason is that once the pedal has been adjusted, the braking effected by the driver is not necessarily strong enough to be able to brake the vehicle correctly because the working travel of the pedal, and accordingly, the serviceable braking force, is not compensated for.

SUMMARY OF THE INVENTION

The object of the present invention is to provide an adjustable brake pedal of the previously mentioned type, the useful travel of which can be compensated for regardless of its position.

To this end, the subject of the present invention is a brake pedal for a vehicle, particularly a motor vehicle, which includes a framework structure which is mounted to rotate about a first rotation spindle connected to the bulkhead of the vehicle. A peg is fixed to one end of a pedal web, and is configured to slide in a slot provided in the framework structure. A movement mechanism is provided to cause the peg to slide in the slot, defining a length (L) between the rotation spindle of the framework structure and the other end of the pedal web. A link is connected to the framework structure, and is mounted for rotation about a second rotation spindle which is configured for connection to the bulkhead of the vehicle, to receive the end of a rod associated with the brake booster of the vehicle at a distance (R) from the second rotation spindle.

In accordance with the present invention, the adjustable brake pedal is further provided with means for obtaining a constant step-down ratio (L/R). In a preferred embodiment, the means for obtaining such a constant step-down ratio (L/R) includes a nut mounted to slide on a worm. The nut is secured to one end of the link and is configured to receive the end of the rod of the brake booster. The other end of the link is preferably secured, by a pivot connection, to a second link, which is itself secured to the framework structure.

The movement mechanism further advantageously comprises an angled reduction gearbox which is coupled to a worm. A nut is secured to the pedal web, and can slide on the worm. The worm and the angled reduction gearbox are preferably fixed to one of the faces of the framework structure.

Advantageously, the ratio between the size of the nut and the size of the worm can be modified as the driver wishes. It is in this way possible for the driver to establish a relationship between the travel of the brake pedal and the force applied to the brake pedal which is tailored to the driver's build.

The present invention also relates to a pedalbox module, which can be fitted in a motor vehicle, and which includes an adjustable brake pedal which is produced in accordance with the present invention. The pedalbox module further advantageously includes a clutch pedal having a movement mechanism which makes it possible to achieve the same spatial movement for the clutch pedal as is achieved with the brake pedal.

Other advantages and features will become apparent from the detailed description which is provided below, together with the following illustrations.

DETAILED DESCRIPTION OF THE INVENTION

Figure 1A:
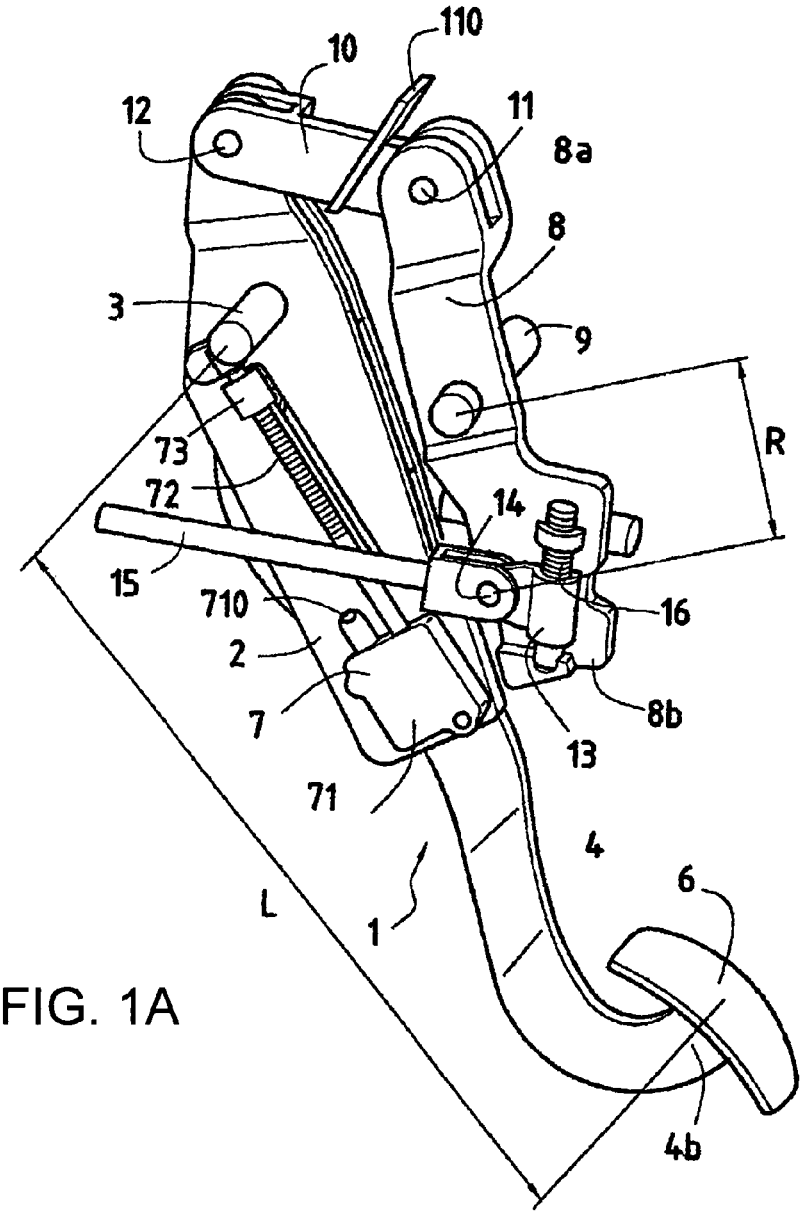
FIGS. 1A and 1B are opposing isometric views of the adjustable brake pedal of the present invention.
Figure 1B:
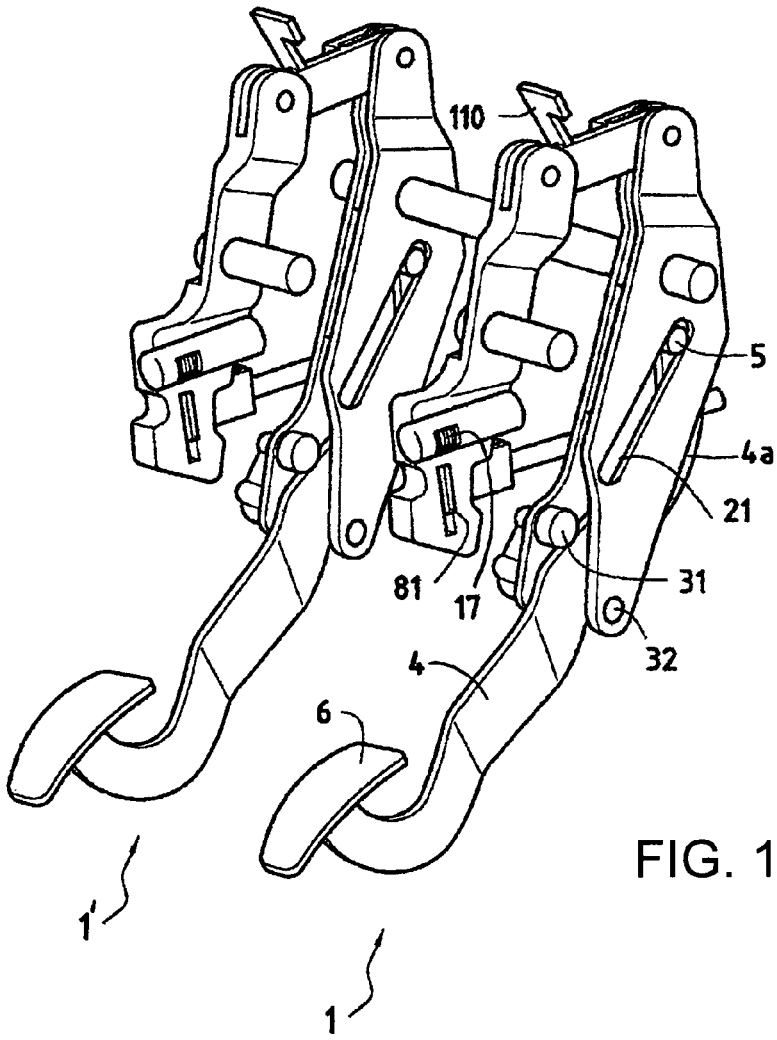

As is shown in FIGS. 1A and 1B, the brake pedal 1 includes a framework structure 2 which is mounted for rotation about a rotation spindle 3. The rotation spindle 3 is mounted on a pedalbox support (not shown), on which a clutch pedal 1' is also mounted, for connection to the bulkhead of a motor vehicle (also not shown).

Lower portions of the framework structure 2 include a pair of rollers 31, 32. A pedal web 4 can slide between the rollers 31, 32. The upper end 4*a* of the pedal web 4 includes a peg 5 which can slide in a slot 21 provided in the framework structure 2. A block 6 is fixed to the lower end 4*b* of the pedal web 4. The block 6 has a shape which is known, per se, and a size which is suited to the vehicle.

A movement mechanism 7 is provided on the outer face of the framework structure 2, to cause the peg 5 to slide in the slot 21. A length (L) is defined between the rotation spindle 3 and the lower end 4*b* of the pedal web 4, approximately at the middle of the block 6. The movement mechanism 7 includes an angled reduction gearbox 71 coupled to a worm 72. A nut 73 is secured to the pedal web 4 and can slide on the worm 72. The angled reduction gearbox 71 includes a gearset, which is known per se and not depicted in the figures. The input 710 of the angled reduction gearbox 71 is in known fashion connected to an electric motor via a transmission cable. For reasons of cost and space, this electric motor also preferably powers other mechanisms for moving other pedals.

The brake pedal 1 also includes a first link 8, which is mounted for rotation about a second rotation spindle 9 which is connected to the bulkhead of the vehicle, and a second link 10, which is fixed to the upper end 8*a* of the link 8 by a pivot connection 11. The second link 10 is itself fixed to the framework structure 2 by another pivot connection 12. The second link 10 also includes a hook 110 for triggering contact switches, such as those which trigger the brake lights or which provide information to a computer.

A connection 13 is fixed to the lower end 8*b* of the link 8. The connection 13 takes the form of a nut for receiving an end of the hydraulic rod 15 of the brake booster (not depicted) associated with the vehicle, at a distance (R) from the second rotation spindle 9. The nut 13 is mounted to slide on a worm 16 which is fixed in a slit 81 provided in the first link 8. The worm 16 can be driven by another worm 17 mounted in a housing made in the first link 8. The free end of the worm 17 can be driven by a transmission cable (not depicted) connected to the electric motor which also powers the angled reduction gearbox 71. As a result, the clevis 14 is spaced from the second rotation spindle 9 by a distance (R) which varies as a function of the location of the nut 13 on the worm 16.

Adjustment of the above-described brake pedal 1, when equipped in a vehicle, will now be described. When the driver of the vehicle enters the vehicle, the position of the brake pedal 1 can be adjusted by actuating the electric motor connected to the angled reduction gearbox 71. The angled reduction gearbox 71 transmits rotational movement to the worm 72, which moves the nut 73 along the worm, parallel to the framework structure 2. This causes the peg 5 of the pedal web 4 to slide in the slot 21, which in turn causes the length (L) between the lower end 4*b* of the pedal web 4 and the rotation spindle 3 to vary. The motor is actuated until a length (Lo) corresponding to a satisfactory driving position for the driver is reached.

At the same time, the electric motor drives the worm 17 via the transmission cable. The worm 17 in turn drives the worm 16 on the nut 13, which slides until the distance (R) is adjusted to reach a value (Ro) wherein the ratio (Lo/Ro) is equal to the initial ratio (L/R). Thus, the brake pedal 1 has a step-down ratio (L/R) that remains constant regardless of the position of the brake pedal 1 with respect to the bulkhead, i.e., regardless of its travel. As far as the driver is concerned, this is manifested in the application of constant braking forces.

It will also be apparent that numerous modifications of the foregoing can be made without departing from the scope of the present invention.

The invention claimed is:

1. An adjustable brake pedal for a vehicle, comprising a framework structure mounted for rotation about a first rotation spindle and connectable to a bulkhead of the vehicle, a pedal web having a peg fixed to a first end and slidably received in a slot in the framework structure, a movement mechanism for causing the peg to slide in the slot and defining a length (L) between the first rotation spindle and a second end of the pedal web, a first link connected to the framework structure and mounted for rotation about a second rotation spindle connectable to the bulkhead of the vehicle, wherein the first link includes a connection for receiving an end of a rod of a brake booster associated with the vehicle at a distance (R) from the second rotation spindle, a first worm associated with one end of the first link, and a first nut coupled with the first worm, wherein the first nut is mounted to slide on the first worm so that the end of the rod of the brake booster is adjusted by the first link to obtain a constant step-down ratio (L/R), and wherein the movement mechanism includes an angled reduction gearbox coupled to a second worm, and a second nut secured to the pedal web for slidingly receiving the second worm.

2. The pedal of claim 1 wherein the second worm and the angled reduction gearbox are fixed to a face of the framework structure.

3. The pedal of claim 1 wherein the angled reduction gearbox is operated by an electric motor, and wherein the first worm is coupled with the electric motor, for rotation responsive to operation of the electric motor.

4. The pedal of claim 3 which further includes a third worm coupling the first worm and the electric motor.

5. The pedal of claim 1 wherein a second end of the first link is secured by a pivoted connection to a second link secured to the framework structure.

6. The pedal of claim 1 wherein the first nut and the first worm are coupled to obtain the constant step-down ratio, and wherein the ratio can be modified by an operator of the vehicle.

7. The pedal of claim 6 wherein the first nut has a position on the first worm, wherein the first worm has a length relative to the first nut, and wherein the length of the first worm relative to the position of the first nut can be modified by the operator of the vehicle.

8. The pedal of claim 1 wherein the first nut is coupled with the connection.

9. A pedalbox module for a motor vehicle, comprising an adjustable brake pedal including a framework structure mounted for rotation about a first rotation spindle and connectable to a bulkhead of the vehicle, a pedal web having a peg fixed to a first end and slidably received in a slot in the framework structure, a movement mechanism for causing the peg to slide in the slot and defining a length (L) between the first rotation spindle and a second end of the pedal web, a first link connected to the framework structure and mounted for rotation about a second rotation spindle connectable to the bulkhead of the vehicle, wherein the first link includes a connection for receiving an end of a rod of a brake booster associated with the vehicle at a distance (R) from the second rotation spindle, a first worm associated with one end of the first link, and a first nut coupled with the first worm, wherein the first nut is mounted to slide on the first worm so that the end of the rod of the brake booster is adjusted by the first link to obtain a constant step-down ratio (L/R), and wherein the movement mechanism includes an angled reduction gearbox coupled to a second worm, and a second nut secured to the pedal web for slidingly receiving the second worm.

10. The module of claim 9 which further includes a clutch pedal having a movement mechanism for achieving spatial movement of the clutch pedal which corresponds to spacial movement of the brake pedal.

11. The module of claim 9 wherein the second worm and the angled reduction gearbox are fixed to a face of the framework structure.

12. The module of claim 9 wherein the angled reduction gearbox is operated by an electric motor, and wherein the first worm is coupled with the electric motor, for rotation responsive to operation of the electric motor.

13. The module of claim 12 which further includes a third worm coupling the first worm and the electric motor.

14. The module of claim 9 wherein a second end of the first link is secured by a pivoted connection to a second link secured to the framework structure.

15. The module of claim 9 wherein the first nut and the first worm are coupled to obtain the constant step-down ratio, and wherein the ratio can be modified by an operator of the vehicle.

16. The module of claim 15 wherein the first nut has a position on the first worm, wherein the first worm has a length relative to the first nut, and wherein the length of the first worm relative to the position of the first nut can be modified by the operator of the vehicle.

17. The module of claim 9 wherein the first nut is coupled with the connection.

* * * * *